United States Patent [19]

Dieringer

[11] 4,256,040

[45] Mar. 17, 1981

[54] PROPORTIONAL CONTROLLER

[75] Inventor: Andrew M. Dieringer, Waterford, Wis.

[73] Assignee: Rexnord Inc., Milwaukee, Wis.

[21] Appl. No.: 915,933

[22] Filed: Jun. 15, 1978

[51] Int. Cl.[3] ..... E01B 29/24

[52] U.S. Cl. ..... 104/17 R; 104/1 R; 307/115; 338/2

[58] Field of Search ..... 104/17 R, 1; 307/112, 307/115, 154, 242; 338/2, 6

[56] References Cited

U.S. PATENT DOCUMENTS

| | | | |
|---|---|---|---|
| 3,454,920 | 7/1969 | Mehr | 338/2 |
| 3,692,157 | 9/1972 | Arnold et al. | 307/115 |
| 3,717,101 | 2/1973 | Katcha et al. | 104/17 R |
| 3,832,895 | 9/1974 | Strandh | 338/2 |

*Primary Examiner*—John J. Love
*Assistant Examiner*—Ross Weaver
*Attorney, Agent, or Firm*—Kinzer, Plyer, Dorn & McEachran

[57] ABSTRACT

In a railroad spike driving machine, the spike driving mechanism is centered over a spike by a system which provides simultaneous proportional control over both the vertical and horizontal positions of the spike driver. The driver is mounted on a carriage whose position is adjustable according to signals derived from the deflection of a control arm. Strain gauges mounted on the control arm sense the push or pull of the operator to adjust the carriage position. The speed of the drive stroke of the hydraulic spike driver is governed by a proportional control valve which is in turn controlled by a signal generated from a trigger switch on the control arm.

8 Claims, 4 Drawing Figures

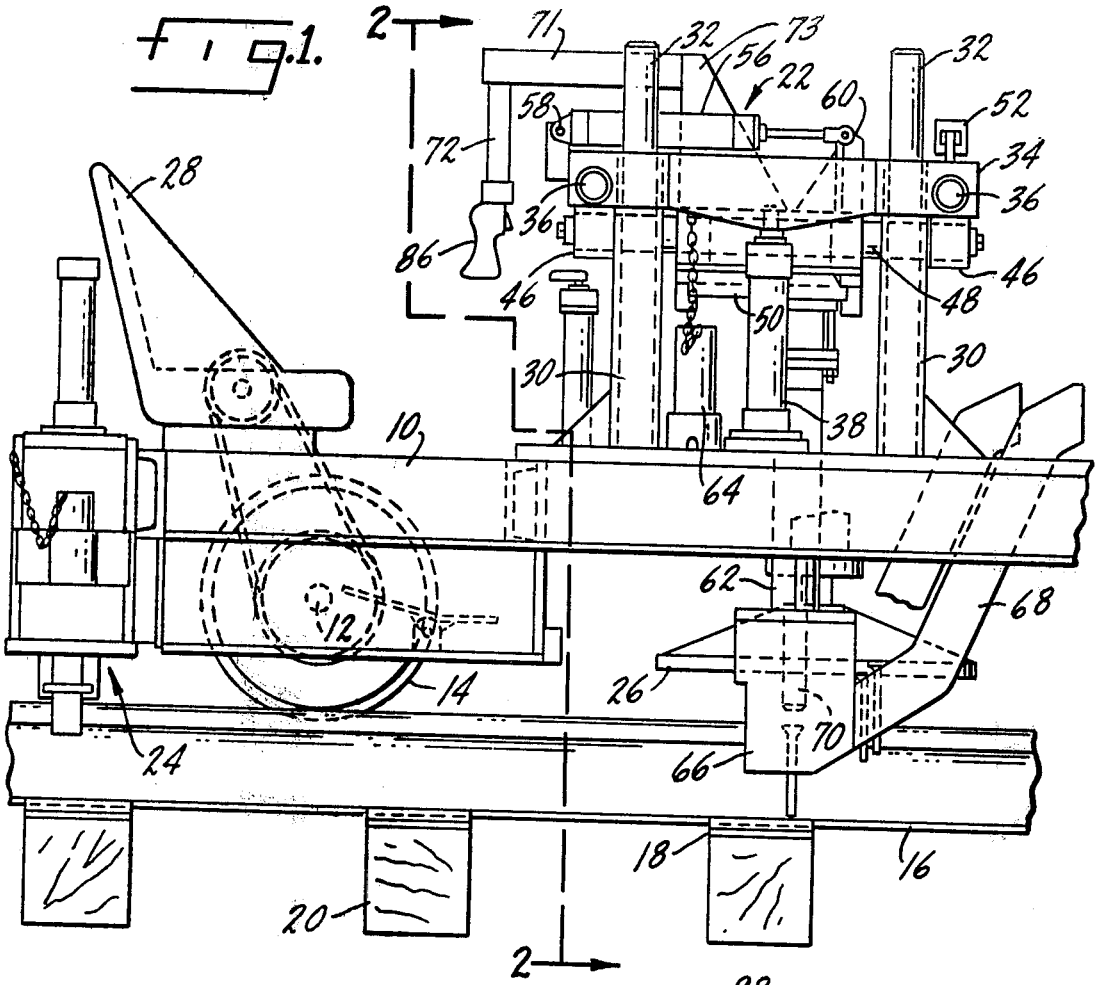
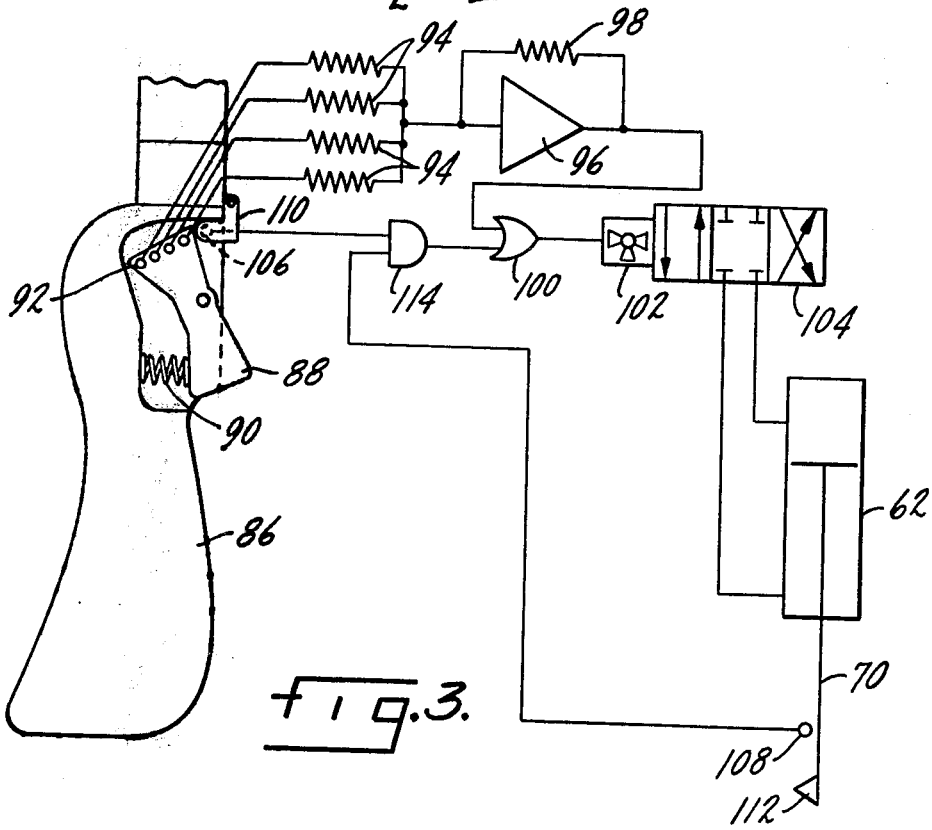
fig.3.

PROPORTIONAL CONTROLLER

BACKGROUND OF THE INVENTION

This invention relates to railroad track working equipment and is particularly concerned with a machine for driving spikes in ties.

In railroad track construction, the rails are laid on tieplates which rest between the tie and the rail. The tieplates are then fastened to the ties by spikes. Generally, two spikes are used for each tieplate, one on each side of the rail. Holes are provided in the tieplate to receive the spikes.

Driving the spikes requires that they be properly aligned with the holes in the tieplate before the driving pressure is applied. This is done with the use of spike holders. Once the spike is aligned, the driver must hit the spike precisely on the head or it will be bent out of shape or improperly driven.

To achieve a high rate of production, the number of misdirected drive strokes must be kept to a minimum. This requires precise alignment of the spike driving mechanism. Early versions of high production spike driving machines used a high impact, hammer-like drive stroke. Because of the high speed of this drive stroke, it was impossible to align after the stroke had been initiated so the only alignment took place while the mechanism was in its fully raised position. This resulted in a high number of miss-hits due to the difficulty of aligning the driver. Later machines used a slower drive stroke. This provided some opportunity for correction of the driver position but still did not permit precise location just before the driver came in contact with the spike.

SUMMARY OF THE INVENTION

An object of this invention is to provide precise control over the alignment of a railroad spike driving mechanism with the spike to be driven.

Another object is the proportional control of the horizontal position of the spike driver.

Another object is the proportional control of the vertical speed of the spike driving mechanism.

Another object is the control over when the spike driving mechanism will move upwardly from its driving position.

Another object is the capability of maintaining the driver in a dwell position at any point in its drive or return strokes.

Another object is a control system for a railroad spike driving mechanism which can be operated in one hand so that a single user can drive two spikes in a tieplate at the same time.

Other objects will appear from time to time in the ensuing specification and drawings.

BRIEF DESCRIPTION OF THE DRAWINGS

FIG. 1 is a side view of a portion of the spike driving machine, showing the parts necessary for locating the driver.

FIG. 3 is a schematic of the control circuit for the spike driver vertical position.

DESCRIPTION OF THE PREFERRED EMBODIMENT

Figure 2:
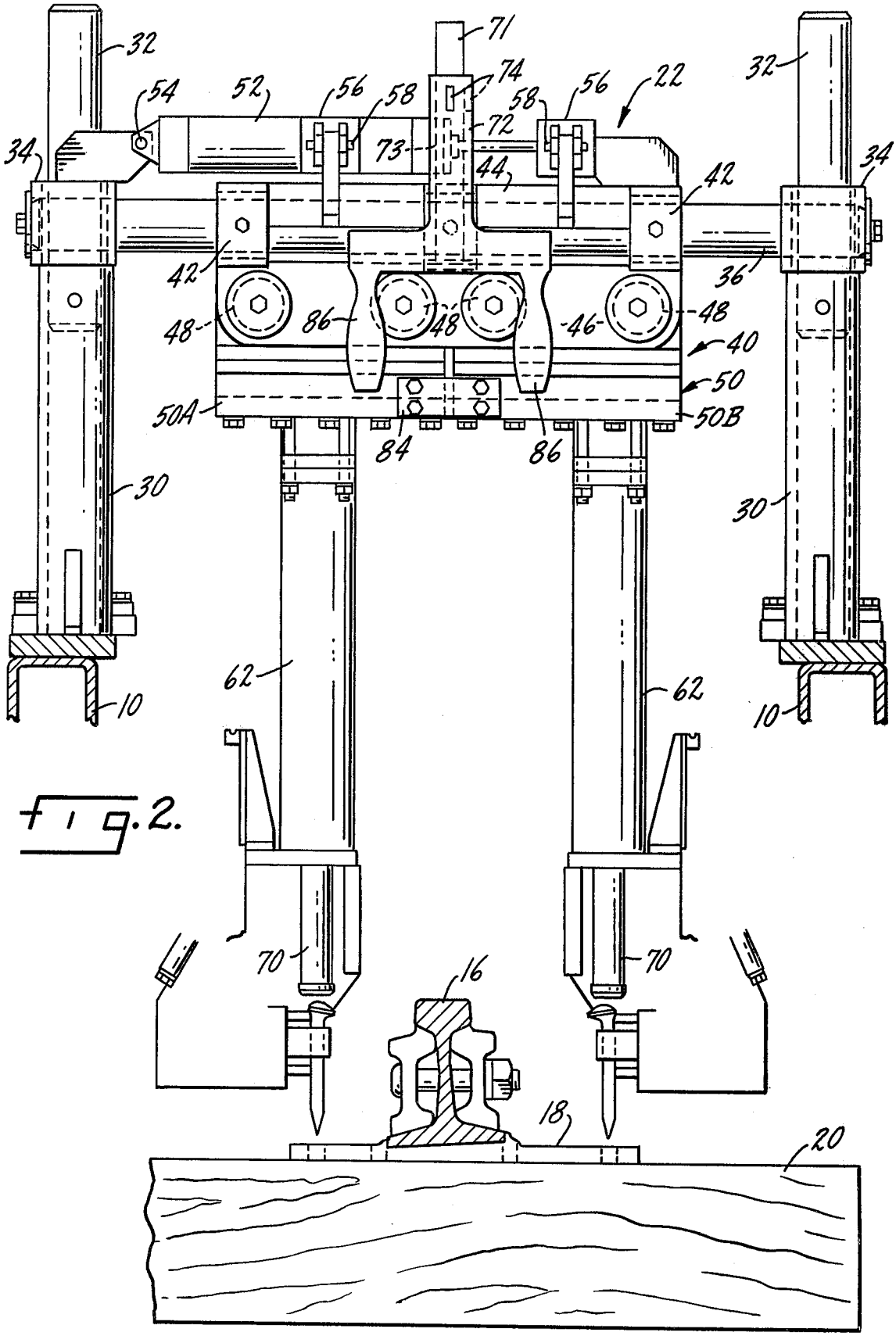
FIG. 2 is a section on an enlarged scale taken along line 2—2 of FIG. 1 with parts omitted.

FIGS. 1 and 2 show the parts of a spike driving machine which are involved with the control system of the present invention. Portions not directly involved with locating the spike driver, such as the engine, hydraulic pump and spike storage bins, have been omitted. The machine has been shown as including a frame 10 with an axle 12 at each end and flanged wheels 14 at the end of each axle adapted to engage a conventional rail 16 of railroad track with the rails on tieplates 18 which in turn rest on the ties 20, all of which is conventional. The machine may be driven by a suitable engine (not shown) mounted on the frame in any desired manner. The engine drives a pump or hydraulic circuit which in turn operates the various parts of the unit and may also propel the machine along the track. The various parts that go to make up the frame will not be described in detail, it being understood that the frame may be made of suitable angle irons, channels, braces, beams and the like, all suitably connected together, such as by welding or the like, into a desirable rigid and sturdy structure to support the various parts and to provide suitable openings for the various operative parts. The frame supports a spike driving assembly, indicated generally at 22 in FIG. 1, rail clamp assemblies at each end as at 24 and a set-off mechanism indicated at 26. The frame may also support seats 28 for the operator. The various hydraulic controls are shown in FIGS. 1 and 2 near the operator's seat as will be explained in detail in connection with the control circuit.

The carriage and spike driving assembly 22 shown in FIGS. 1 and 2, may include four vertical posts 30 disposed in a square or rectangle, on one side of the frame laterally so that it is disposed over one of the rails. Each post may take the form of a tube or cylinder with a stub shaft or dowel 32 pinned and projecting above the upper end. A frame mechanism is slidably mounted on the pins or dowels 32 and includes longitudinal beams 34 having holes or sleeves toward each end which fit down over the pins or dowels 32 and are constructed to abut the top of the tubes or posts 30. The ends of the beams 34 are connected by shafts 36, one at each end which, together with the beams, make up a box-type frame. This box-type frame is adapted to be raised or lowered on the pins 32 by two piston and cylinder assemblies 38, one on each side.

The shafts 36 support a movable carriage 40 which is constructed to be moved laterally or at right angles to the rails so as to position the spike driving cylinders or "guns" in a manner explained later. The carriage 40 includes sleeves 42 shown as three on each shaft 36 in FIG. 2, which are interconnected by spacer bars 44 which may be welded to them. Also, each shaft 36 carries a beam 46 swung beneath it by the sleeves 42 and the beams are joined to each other by slide rods 48, shown in this case as four. The slide rods 48, beams 46, spacer bars 44 and the sleeves 42 make up the carriage which, as a unit, is adapted to slide in either direction across the rails.

A sub-carriage 50 is mounted on the slide rods 48 and is adapted to slide either forward or backward in a direction generally parallel to the rails. The sub-carriage may be divided into a left and right hand side 50A and 50B, each of which is in the form of a box-type frame with suitable openings to slide on the rods 48. A hydraulic cylinder 52 may be mounted as at 54 on the end of one of the beams 34 of the main frame with its piston rod connected to one of the sleeves 42 of the carriage 40. Since the cylinder 52 is disposed laterally, it will move the main carriage in a direction across the rails.

Two cylinders 56 are pivoted as at 58 to one of the spacer bars 44 with their piston rods connected at their other end to a suitable upstanding bracket 60 on the box-type sub-frame 50 so that the operation of these cylinders will move the sub-frame longitudinally parallel to the rails. The lower surface of each sub-frame may support a depending spike driving piston and cylinder which is commonly referred to as the spike driving gun indicated at 62 with its upper end adjustably mounted on the bottom of the sub-frame. One of the guns drives spikes outside the rail and the other inside.

The main upper frame comprising beams 34 and shafts 36 may be raised and lowered on the dowels or pins 32 by the cylinders 38. For travelling, the pistons 38 raise the upper frame which raises the carriages, sub-carriages and spike driving guns a suitable distance so that a lock tube 64, C-shaped in cross-section, may be slipped around the exposed upper portion of the piston rod and left in a place so that when a lift cylinder 38 is released, the weight of the upper frame, carriages and driving guns will be taken by the lock tube.

Each of the spike driving guns 62 has a lower frame 66 (FIG. 1) attached to it which may include a pair of pivoted spike holding jaws and a spike feed shute 68. The shute supplies spikes, one at a time, to a position under the piston or driver 70 of the spike gun to be driven through the hole in the tie plate into the tie.

It will be understood that the structure described to this point is conventional and is generally the same as that shown in U.S. Pat. No. 3,717,101, issued Feb. 20, 1973 and assigned to this assignee.

This invention is concerned with controlling the above-described mechanism in such a manner as to provide precise alignment of the spike driving gun with the spike. This is accomplished by allowing horizontal alignment of the gun as it proceeds downwardly. This means the operator can make last second adjustments as he sees exactly where the driving guns are coming down. This simultaneous control of both the gun's vertical position and horizontal position is provided in the following manner.

Figure 4:
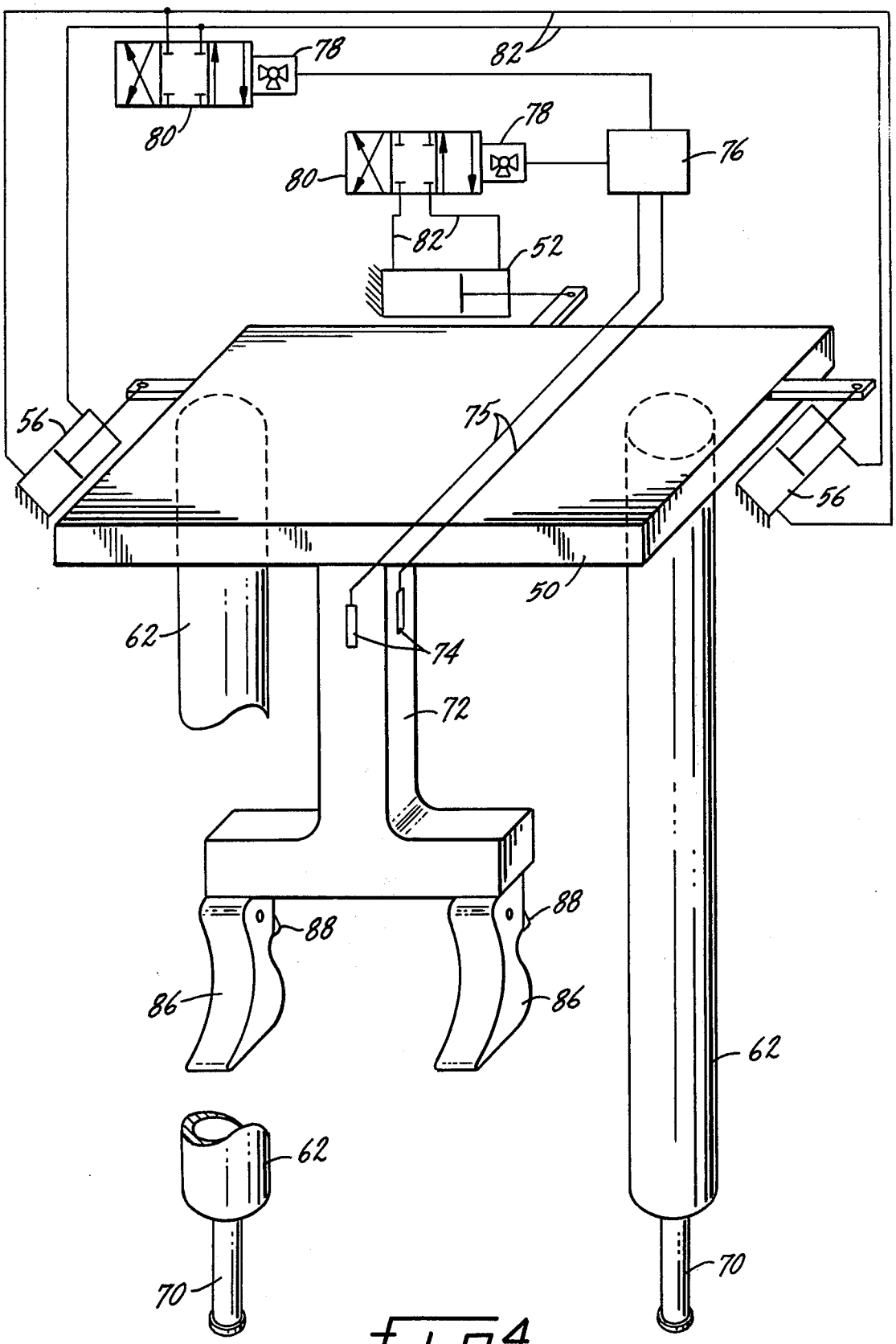
FIG. 4 is a schematic of the horizontal control system.

A control arm 72, as shown in FIG. 1, is suspended before the operator, attached to the sub-carriage 50 by bracket 71 and vertical support 73. Resistance strain gauges 74 are mounted on the arm 72. As shown in the diagram of FIG. 4, the strain gauges are electrically connected by leads 75 to an appropriate bridge circuit located in a box 76. When the operator pushes or pulls on the control arm, the strain gauges create an imbalance in the circuit thereby inducing a proportional carriage control signal. This signal is fed to a proportional control valve 78 which operates carriage cylinders 52 and 56 via three-way valves 80 and hydraulic lines 82. Thus, minute adjustments can be made in the horizontal position of the spike driving mechanism.

Strain gauges can be mounted on the control arm such that longitudinal and lateral control of the carriage is possible. In general, however, it is only necessary to provide fine adjustment of the longitudinal carriage position. This is so because once the machine has been set up, a reference line is established which sets the lateral position of the carriage. This is explained in detail in the above referred-to U.S. Pat. No. 3,717,101.

Although a single control arm is shown in FIG. 2, dual control arms could be provided to permit independent control of the spike driving guns 62. This would necessitate the removal of a strap 84 (FIG. 2) from the sub-carriages 50A and 50B so that they move independently on the slide rods 48.

The spike driving gun control is shown schemmatically in FIG. 3. This control includes a handle or grip 86 attached at the bottom of the control arm 72. The handle has a shroud or trigger switch 88 which is spring-biased as at 90 to normally cover a plurality of light emitting diodes 92. When uncovered, these light emitting diodes or LED's generate signals which are connected in parallel through resistors 94 to the input of an operational amplifier 96. This amplifier has a resistance feed back loop 98 causing it to act as an adder of the incoming signals in the known manner. As the operator squeezes the trigger switch 88, the LED's become uncovered one at a time, and the signals are then added by the amplifier circuit. In theory, this would provide a stepwise increasing output from the amplifier but it has been found in practice to provide a gradually increasing output. This output is then connected to an OR gate 100 and from there to a proportional control valve 102. Energization of the operational amplifier sets three-way control valve 104 in a down mode such that fluid pressure is applied to the top of the spike driving gun 62 thereby causing the piston and rod 70 to move downwardly. The level of the signal provided to the proportional control valve, governs the pressure fed to the cylinder so that the speed of the downward motion is controlled thereby, which means the operator can control the speed of the spike driving gun by the number of LED's he has uncovered with the trigger switch. For example, when starting a drive stroke from a fully raised position, the operator can squeeze the trigger to energize all of the LED's and provide the fastest downward motion. As the rod approaches the spike head, the operator can allow the shroud to gradually cover the LED's again, slowing the downward stroke so that the last second horizontal adjustments of the gun position can be made by deflecting the control arm as explained above.

The initiation of a return stroke is governed by the existence of signals from LED's 106 and 108. The first of these is mounted on the grip 86 and is normally covered by an auxiliary shroud 110. When the trigger switch 88 is squeezed, it will also cover the LED 106 blocking out any possibility of a raise signal being generated during a down stroke. The secondary LED 108 is positioned such that a vane 112 on the piston and rod assembly will cover the LED when the piston is in its fully raised position. Thus, as the piston returns from a drive stroke, the return stroke will conclude as the vane cover the LED 108.

LED's 106 and 108 are connected to an AND gate 114 whose output is then fed to OR gate 100. Therefore, both LED's must be uncovered before a return stroke can be initiated. When both the trigger switch 88 and auxiliary shroud 110 are in a normal position, neither a drive stroke nor a return stroke can take place. In this condition, the three-way valve 104 assumes a neutral mode and the spike driving gun will dwell at whatever position it has last attained. To raise the spike driver, the operator must release the trigger switch 88 and rotate the auxiliary shroud 110 and, of course, the piston and rod assembly must be in a lowered position so LED 108 is not covered by vane 112.

It can be seen then that the operator can control the vertical and horizontal position of the spike driving gun by manipulating controls maintained in one hand. While the preferred form and alternate arrangements have been shown and suggested, it should be understood that suitable additional modifications and alterations may be made without departing from the invention's fundamental theme.

The embodiment of the invention in which an exclusive property or priviledge is claimed is defined as follows:

1. In a machine for driving spikes into railroad track, a frame with wheels adapted to engage the rails so that the frame can move along the track;

a movable carriage mounted on the frame;

means for locating the carriage;

a spike driver attached to the carriage;

a control arm;

carriage control means mounted on the control arm for providing proportional control of the carriage position; and a spike driver controller mounted on the control arm and including speed regulating means for providing proportional control of the speed of a drive stroke, and means for effecting a return stroke of the spike driver.

2. The structure of claim 1 further characterized by strain transducers mounted on the control arm such that deflection of the control arm induces in the strain transducers a proportional carriage control signal which governs operation of the carriage locating means.

3. The structure of claim 2 wherein the strain transducers are resistance strain gauges connected to a bridge circuit, the output of which is the proportional carriage control signal.

4. The structure of claim 1 wherein the spike driver controller includes dwell means for stopping the drive stroke at a desired position.

5. The structure of claim 1 which includes a spike driver of the hydraulic cylinder and piston type with a three-way valve and proportional control valve in the hydraulic pressure fluid line and wherein the speed regulating means comprises a plurality of light-sensitive electric power sources covered by a movable shroud which normally covers the power sources making them inoperative, each source being connected to the input of an operational amplifier with a resistance feedback so that as the shroud is moved by the machine user to progressively uncover the power sources, they become operative and their outputs are combined by the amplifier circuit thus generating a control signal proportional to the number of uncovered power sources, the control signal then being used to govern the operation of the proportional control valve.

6. The structure of claim 5 wherein the spike driver controller includes dwell means for stopping the drive stroke at a desired position and wherein the spike driver controller further comprises a first light-sensitive power source located such that a vane mounted on the driver will cover the source when the driver is in its fully raised position, a second light-sensitive power source located such that moving the shroud of the speed regulating means from its normal position will cover the second source, the first and second power sources connected to the three-way valve in such a manner that when both sources are uncovered and operative, the spike driver will move upwardly.

7. The structure of claim 6 wherein the dwell means comprises an auxiliary shroud which normally covers the second power source so that when neither the speed regulating shroud nor the auxiliary shroud is actuated from its normal position no signals are generated by the spike driver controller so the driver remains in whatever position it has last assumed.

8. In a machine for driving spikes in railroad track, a frame with wheels adapted to engage the rails so that the frame can move along the track, a movable carriage mounted on the frame, means for locating the carriage, a spike driver of the hydraulic cylinder and piston type, attached to the carriage, with a three-way valve and proportional control valve in the hydraulic pressure fluid line and speed regulating means comprising:

a plurality of light-sensitive electric power sources covered by a movable shroud which normally covers the power sources making them inoperative, each source being connected to the input of an operational amplifier with a resistance feedback so that as the shroud is moved by the machine user to progressively uncover the power sources, they become operative and their outputs are combined by the amplifier circuit thus generating a control signal proportional to the number of uncovered power sources, the control signal then being used to govern the operation of the proportional control valve.

* * * * *